US007850588B2

(12) United States Patent
St. Ours et al.

(10) Patent No.: US 7,850,588 B2
(45) Date of Patent: Dec. 14, 2010

(54) FOLDER WITH COMMON CHOPPER

(75) Inventors: Joseph Adrian St. Ours, Lee, NH (US); Mark Anthony Wingate, New Durham, NH (US); David Elliot Whitten, Barrington, NH (US)

(73) Assignee: Goss International Americas, Inc, Durham, NH (US)

( * ) Notice: Subject to any disclaimer, the term of this patent is extended or adjusted under 35 U.S.C. 154(b) by 0 days.

(21) Appl. No.: 11/904,069

(22) Filed: Sep. 26, 2007

(65) Prior Publication Data

US 2009/0082188 A1 Mar. 26, 2009

(51) Int. Cl.
*B31F 1/10* (2006.01)

(52) U.S. Cl. ..... 493/423; 493/360; 493/370; 493/442; 493/454; 270/5.01; 270/8; 270/16; 270/20.1; 270/40

(58) Field of Classification Search ..... 493/360, 493/370, 397, 403, 423, 424, 434, 442, 454; 270/5.01, 8, 16, 20.1, 40, 41
See application file for complete search history.

(56) References Cited

U.S. PATENT DOCUMENTS

| | | | | |
|---|---|---|---|---|
| 868,854 | A * | 10/1907 | Firm | 270/41 |
| 868,918 | A * | 10/1907 | Firm | 270/41 |
| 3,038,719 | A | 6/1962 | Tyma | |
| 3,632,104 | A * | 1/1972 | Dufour | 493/444 |
| 3,657,998 | A | 4/1972 | Yoritomi | |
| 4,338,086 | A | 7/1982 | Heater | |
| 4,549,728 | A * | 10/1985 | Odeau | 270/46 |
| 5,222,934 | A | 6/1993 | Ochsner | |
| 5,468,209 | A | 11/1995 | Rohrihiursch et al. | |
| 5,653,429 | A | 8/1997 | Michalik et al. | |
| 5,899,843 | A | 5/1999 | Stab | |
| 6,688,224 | B2 | 2/2004 | Herda et al. | |
| 7,022,059 | B2 * | 4/2006 | Kitai et al. | 493/444 |
| 7,438,677 | B2 * | 10/2008 | Fujiwara | 493/434 |
| 2005/0103215 | A1 | 5/2005 | Janzen | |
| 2008/0272531 | A1 | 11/2008 | Chrigui | |

FOREIGN PATENT DOCUMENTS

| | | |
|---|---|---|
| DE | 10210030 A1 | 10/2002 |
| JP | 61-55067 | 3/1986 |

* cited by examiner

*Primary Examiner*—Hemant M Desai
(74) *Attorney, Agent, or Firm*—Davidson, Davidson & Kappel, LLC

(57) ABSTRACT

A folder includes a first signature conveyor conveying first signatures along a first signature path; a second signature conveyor conveying second signatures along a second signature path; and a chopper located between the first and second signature paths imparting a fold on both the first and second signatures. A chopper and method are also provided.

9 Claims, 4 Drawing Sheets

FOLDER WITH COMMON CHOPPER

The present invention relates generally to printing presses, and more particularly to a folder for a printing press.

BACKGROUND OF THE INVENTION

In the web offset printing process, a continuous web of paper is transported through a printing press. Near the beginning of the press, one or more printing units apply ink to the web to repeatedly create a pattern, or impression, of text and images. At the end of the press, a web conversion machine, such as a folder, is typically used to cut and fold the web into signatures.

There are many known ways to convert a web into signatures. The web is commonly slit into ribbons, which can be stacked on top of each other and then former folded. Some folders, such as pinless former folders, cut the ribbons or web and deliver one or more streams of signatures. Other folders, such as combination folders, commonly introduce additional folds, such as half-folds and quarter-folds.

A common method of creating a quarter fold uses a chopper module. A chopper module has a blade that forces signatures through a nip formed by two rotating rollers. The signature is folded as it passes through the nip.

As shown in FIG. 1, due to limitations on space between consecutive signatures, paper dynamics, and mechanical component strength, a high speed folder 10 typically has two chopper modules 12, 14, each folding every other signature. Using two chopper modules 12, 14 allows both chopper modules 12, 14 to run at roughly half the speed of the printing press, making it possible to produce high quality quarter folded products. Chopper modules 12, 14 are expensive from both a cost and space standpoint.

SUMMARY OF THE INVENTION

The present invention provides a folder including a first signature conveyor conveying first signatures along a first signature path; a second signature conveyor conveying second signatures along a second signature path; and a chopper located between the first and second signature paths imparting a fold on both the first and second signatures.

The present invention also provides a chopper including a chopper drum having a first axis of rotation; a chopper blade attached to the chopper drum and having a second axis of rotation different from the first axis of rotation; and two chopper tables having gaps, the chopper blades extending through the gaps as the chopper drum rotates about the first axis of rotation and the chopper blade rotates about the second axis of rotation.

The present invention also provides a method for folding signatures using a chopper including the steps of transporting first signatures along a first signature path; transporting second signatures along a second signature path; and folding the first and second signatures using a common chopper located between the first and second signature paths.

Figure 1:
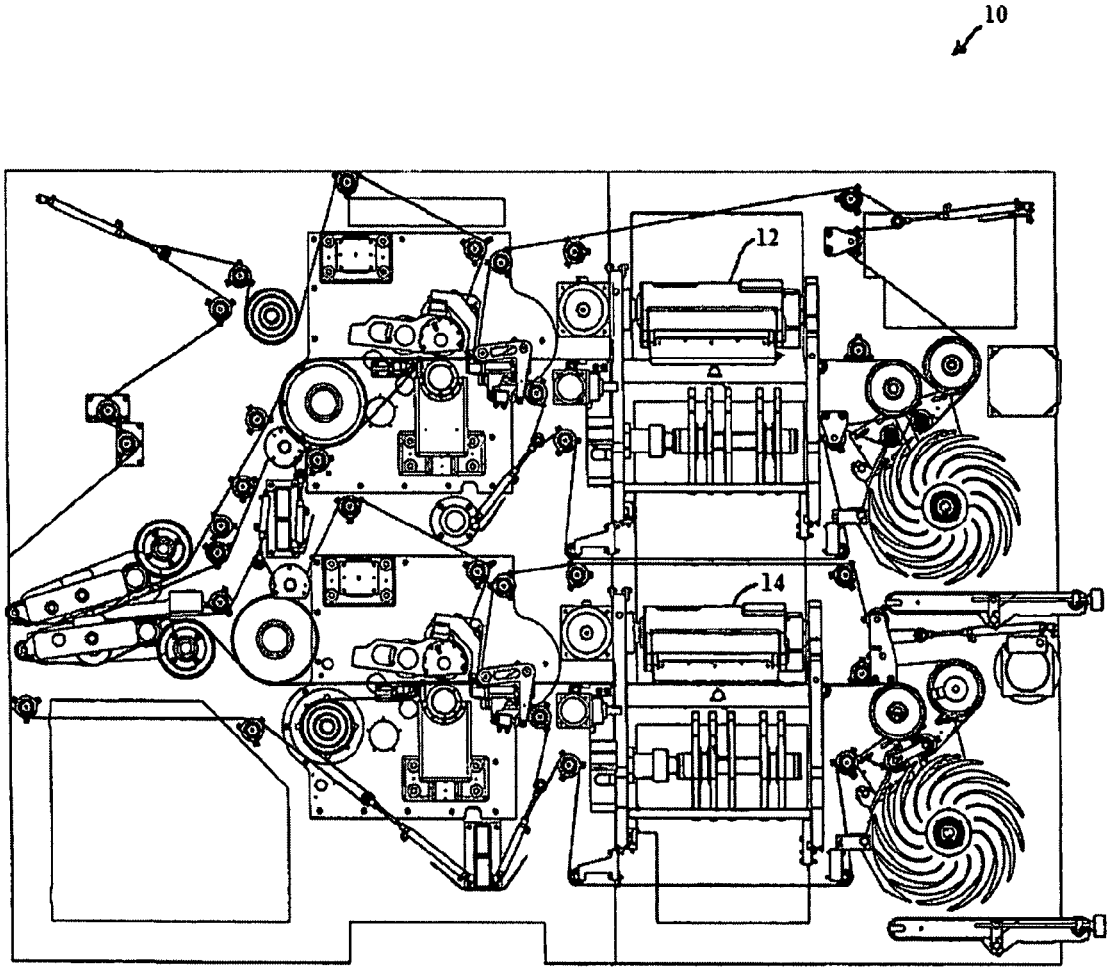
Figure 1 (Prior Art)
FIG. 1 shows a prior art folder having two chopper modules.
Figure 2A:
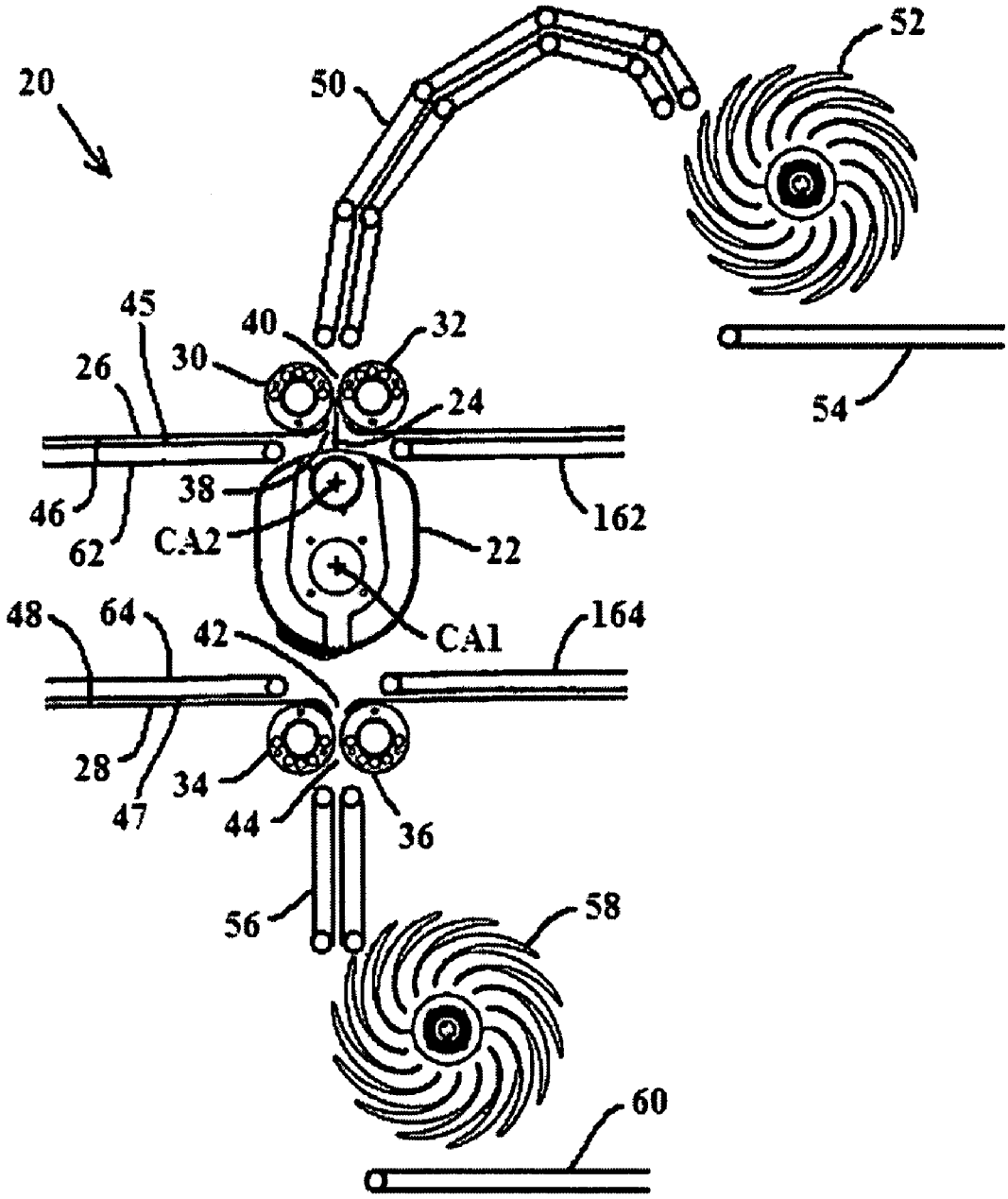
Figure 2B:
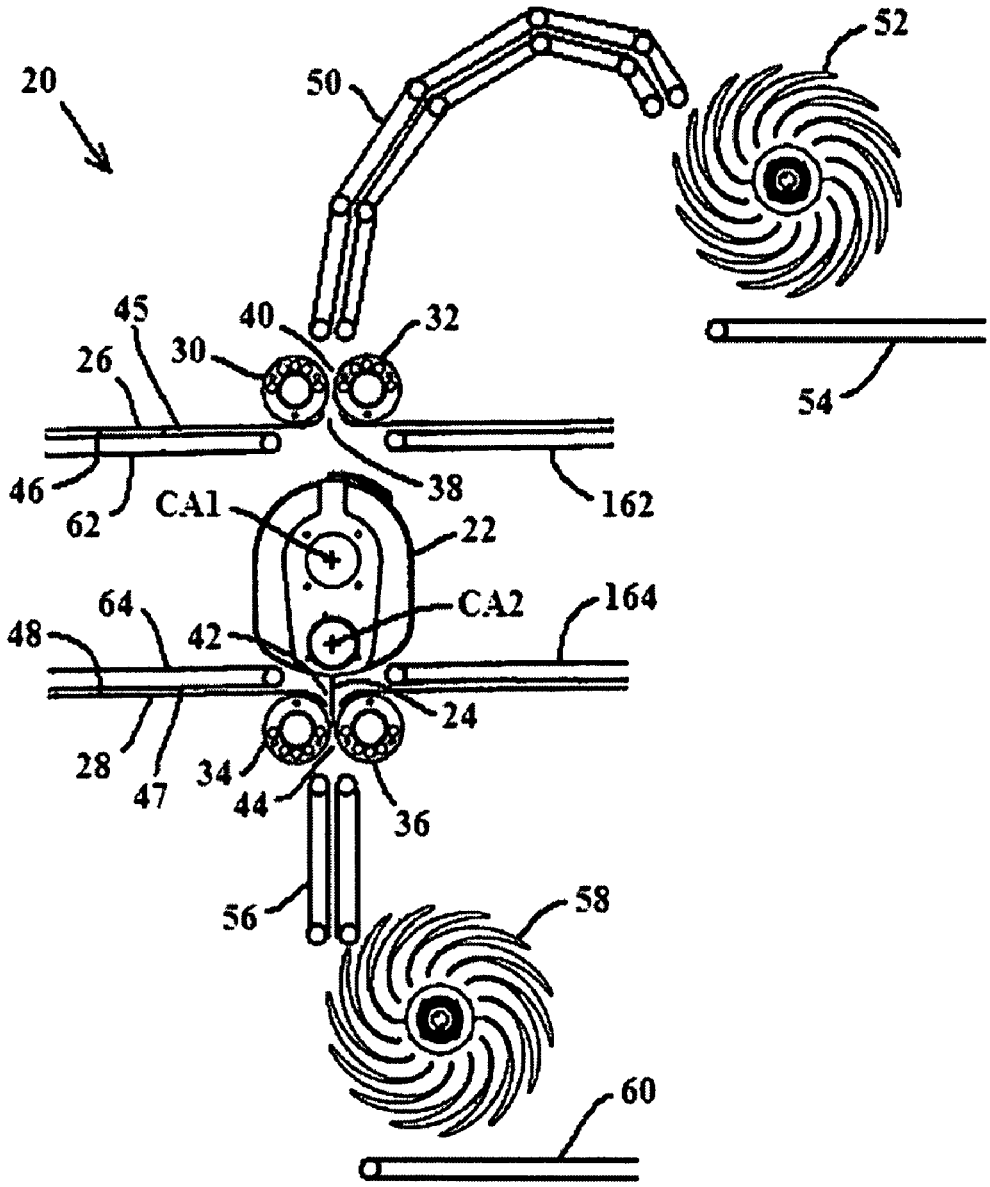
Figure 3A:
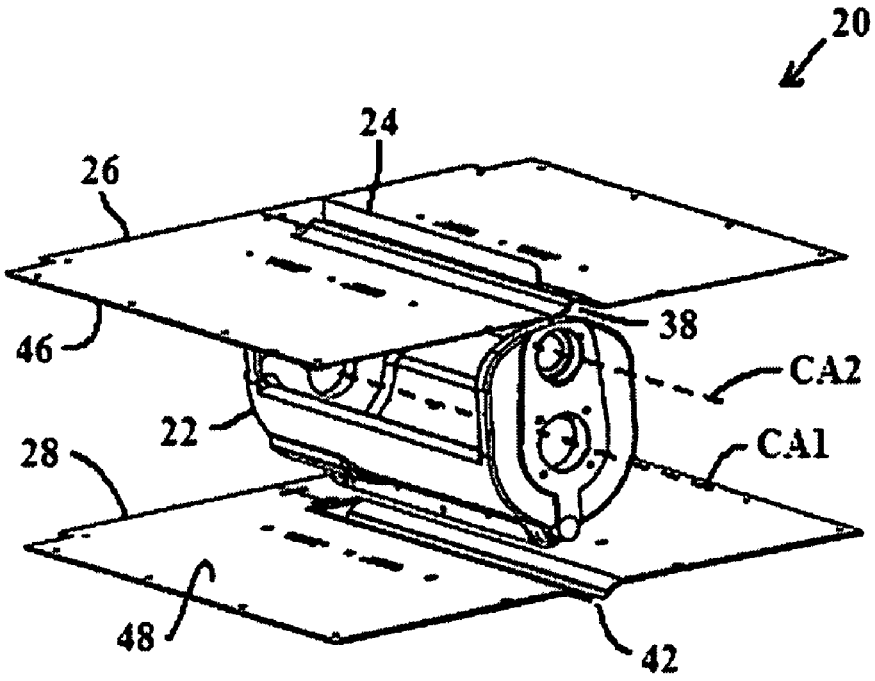
Figure 3B:
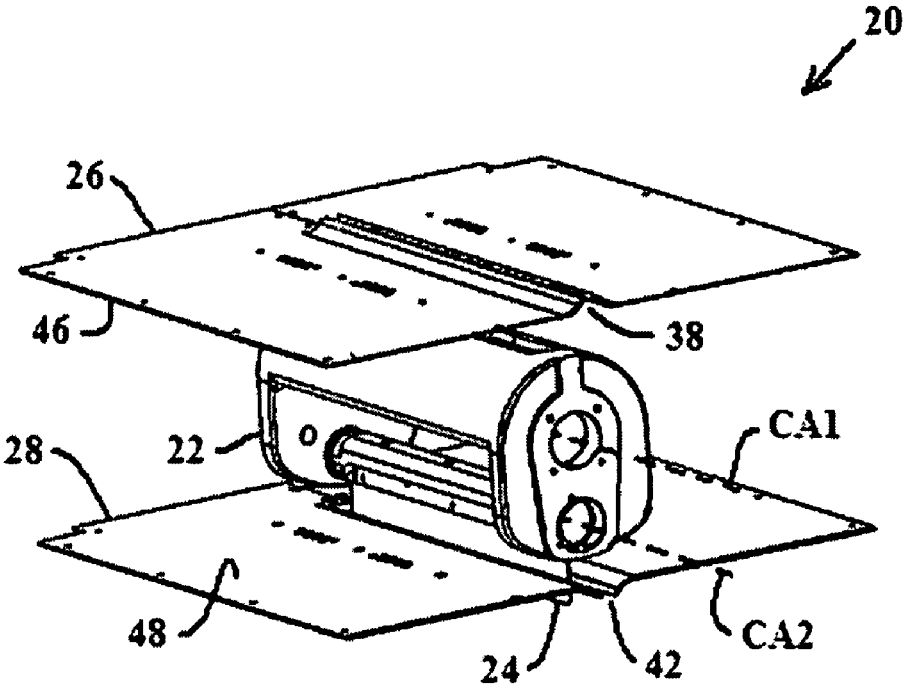

A preferred embodiment of the present invention will be elucidated with reference to the drawings, in which:

FIGS. 2A and 2B show two-dimensional views of a chopper module according to the present invention; and FIGS. 3A and 3B show three-dimensional views of a chopper module according to the present invention.

DETAILED DESCRIPTION

FIGS. 2A and 2B describe a chopper module 20 according to the present invention, having a chopper drum 22, a chopper blade 24, an upper chopper table 26, a lower chopper table 28, upper rollers 30, 32 and lower rollers 34, 36. During folder operation, chopper drum 22 rotates about center axis CA1. As chopper drum 22 rotates, chopper blade 24 rotates with respect to chopper drum 22 about center axis CA2.

When chopper blade 24 is above and below center axis CA1, chopper blade 24 extends radially outward from center axis CA1. As shown in FIG. 2A, when chopper blade 24 is above center axis CA1, chopper blade 24 passes through a gap 38 in upper chopper table 26 and approaches a nip 40 formed by upper rollers 30, 32. As shown in FIG. 2B, when chopper blade 24 is below center axis CA1, chopper blade 24 passes through a gap 42 in lower chopper table 28 and approaches a nip 44 formed by lower rollers 34, 36.

During folder operation, signatures are transported along a first signature path 45 and a second signature path 47. First signature conveyors 62, 162 transport every other signature along first signature path 45 adjacent to inner surface 46 of chopper table 26. Second signature conveyors 64, 164 transport intermediate signatures along second signature path 47 adjacent to inner surface 48 of chopper table 28. When the signatures are properly positioned next to chopper drum 22, chopper blade 24 pushes the signatures through gaps 38, 42 and into nips 40, 44 to create folds. Transport tapes 50, 56 or other guides carry the folded signatures to fans 52, 58. Fans 52, 58 place the signatures on deliveries 54, 60.

FIGS. 3A and 3B show three-dimensional views of chopper module 20 in the same configurations as FIGS. 2A and 2B, respectively. Rollers 30, 32, 34, 36 are omitted from FIGS. 3A and 3B so that chopper blade 24 can be seen passing through gaps 38, 42.

Chopper module 20 is similar to prior art chopper modules 12, 14 except that chopper module 20 includes upper chopper table 26 and upper rollers 30, 32. By adding upper chopper table 26 and upper rollers 30, 32, the radial extension of chopper blade 24 above center axis CA1 can be used to create an additional fold. In the prior art, this extension of the chopper blade above CA1, called a phantom chop, is not used to create a fold.

By using the phantom chop to create a fold, chopper module 20 can produce the same number of folds as prior art chopper modules 12, 14 combined. The present invention thus allows two chopper modules 12, 14 to be replaced by one chopper module 20. Chopper module 20 can operate at the same RPM as existing choppers 12, 14 and thus can create two folded books of the same quality of the existing choppers 12, 14. Folder design is advantageously simplified and cost-reduced.

In a further embodiment, a folder can include two chopper modules 20, each imparting a fold on opposing signatures instead of one chopper module 20. Using two chopper modules 20 allows the rotational speed of chopper modules 20 to be cut in half for the same output produced by prior art chopper modules 12, 14. The lower rotational speed advantageously produces higher quality folds and reduces the speed requirements of post-press equipment while maintaining the throughput of the folder.

What is claimed is:

1. A folder comprising:

a chopper located between a first signature path and a second signature path alternately folding both the first signatures and second signatures, the chopper including a chopper blade folding both the first signatures and second signatures alternately;

a first signature conveyor conveying the first signatures to the chopper along the first signature path; and a second signature conveyor conveying the second signatures to the chopper along the second signature path.

2. The folder as recited in claim 1 wherein the chopper includes a first chopper table for the first signatures having a first gap, a second chopper table for the second signatures having a second gap, and a chopper blade for passing between the first and second gaps.

3. The folder as recited in claim 2 further comprising a first fan for the first signatures and a second fan for the second signatures.

4. The folder as recited in claim 3 further comprising a set of guides between the first chopper table and the first fan.

5. The folder as recited in claim 2 further comprising first rollers on an opposite side of the first chopper table with respect to the chopper and second rollers on an opposite side of the second chopper table with respect to the chopper.

6. The folder as recited in claim 5 wherein the first rollers form a first nip adjacent to the first gap and the second rollers form a second nip adjacent to the second gap.

7. A folder comprising:

a first signature conveyor conveying first signatures along a first signature path;

a second signature conveyor conveying second signatures along a second signature path; and a chopper located between the first and second signature paths including a chopper blade having a folding tip, the chopper blade folding both the first and second signatures by alternately contacting the first and second signatures with the folding tip.

8. A folder comprising:

a chopper drum rotating about a first axis;

a chopper blade rotating with respect to the chopper drum about a second axis;

a first chopper table above the chopper drum having a first gap;

a second chopper table below the chopper drum having a second gap;

a first signature conveyor between the chopper drum and the first chopper table conveying first signatures along a first signature path;

a second signature conveyor between the chopper drum and the second chopper table conveying second signatures along a second signature path;

wherein the chopper blade pushes each of the first signatures through the first gap and pushes each of the second signatures through the second gap.

9. The folder as recited in claim 8 further comprising:

a pair of first rollers above the first chopper table receiving each of the first signatures as the chopper blade pushes each of the first signatures through the first gap; and a pair of second rollers above the second chopper table receiving each of the second signatures as the chopper blade pushes each of the second signatures through the second gap.

* * * * *